United States Patent [19]

Ketterer

[11] 4,185,572

[45] Jan. 29, 1980

[54] ELECTRO-MECHANICAL ACTUATOR FOR USE IN A SEWING MACHINE

[75] Inventor: Stanley J. Ketterer, Jamesburg, N.J.

[73] Assignee: The Singer Company, New York, N.Y.

[21] Appl. No.: 889,325

[22] Filed: Mar. 23, 1978

[51] Int. Cl.[2] ..... D05B 3/02

[52] U.S. Cl. ..... 112/158 E

[58] Field of Search ..... 112/158 E, 158 R, 220, 112/221

[56] References Cited

U.S. PATENT DOCUMENTS

| | | | |
|---|---|---|---|
| 4,074,641 | 2/1978 | Tholander et al. | 112/158 E |
| 4,086,861 | 5/1978 | Ketterer et al. | 112/158 E |

FOREIGN PATENT DOCUMENTS

| | | | |
|---|---|---|---|
| 2702488 | 7/1977 | Fed. Rep. of Germany | 112/158 E |

*Primary Examiner*—Peter Nerbun

*Attorney, Agent, or Firm*—David L. Davis; Robert E. Smith; Edward L. Bell

[57] ABSTRACT

A sewing machine is disclosed wherein positioning of the needle is controlled by an actuator mechanism responsive to digital stitch pattern signals applied thereto. The actuator mechanism includes four solenoids selectively energized by the digital stitch pattern signals. The four solenoids are chosen to have particular binary-related axial displacements and are mounted in such a manner that a doubly pivoted lever driven by the solenoids provides a displacement at one end thereof which is additive of the selected solenoid energization. This one end of the lever shifts a bar that has an opening into which the periphery of a first cam extends. This first cam is axially free on the arm shaft of the sewing machine but is keyed to rotate with it. A yoke spans the cam and is restrained from rotating, but is moved axially by the cam. The yoke is operatively connected to laterally position the needle bar. A bar restraining brake is actuated by a second cam on the arm shaft and is timed to release when the solenoids are shifting the lever. The brake restrains the bar when the first cam is driving the yoke so as to position the needle bar, thereby utilizing the power of the sewing machine main motor.

4 Claims, 11 Drawing Figures

ELECTRO-MECHANICAL ACTUATOR FOR USE IN A SEWING MACHINE

BACKGROUND OF THE INVENTION

This invention relates to sewing machines and, more particularly, to an improved actuator for use in sewing machines utilizing stitch pattern signal responsive actuators for positioning the needle and/or the work feeding mechanism between successive stitches of a predetermined pattern.

In recent years, so called "electronic" sewing machines have gained in popularity and have met with commercial success in both industrial and domestic applications. These electronic sewing machines typically include a memory unit for storing in digital form information to control both the needle positioning mechanism and the work feeding mechanism to automatically produce a desired pattern. Signals generated from the stored information are applied to signal responsive actuators for selectively positioning the needle and the work feeding mechanism. These actuators may be of either the analog or the digital type. An analog actuator is responsive to an analog signal for positioning its associated mechanism at a point along a continuum between two extreme positions. The present invention is concerned with digital actuators wherein the actuator responds to digital input signals to position its associated mechanism at a selected one of a plurality of incrementally displaced discrete points between two extreme positions.

Digital actuators, per se, are well known. For example, both linear motors and stepping motors have been utilized in the prior art as actuators to position the needle bar and/or the work feeding mechanism in a sewing machine in response to stitch pattern signals stored in and retrieved from a memory unit. However, both of these types of actuators require some form of signal conversion from the digitally stored information to a signal usable as an input to the actuator itself. Thus, the linear motor requires a digital to analog converter to convert a digital input signal to an analog voltage level and the stepping motor actuator requires signal processing to provide appropriate signals for positioning the stepping motor. Such signal conversion requires circuitry which adds to the cost of the sewing machine.

It is therefore an object of the present invention to provide an actuator directly responsive to digital input signals.

Typically, the prior art actuators are directly coupled, through some intermediate linkage, to the controlled mechanism. This requires that the actuator have sufficient power to move both the intermediate linkage and the controlled mechanism.

It is therefore another object of this invention to provide an arrangement whereby the actuator mechanism may be of reduced size and have reduced power requirements.

SUMMARY OF THE INVENTION

In accordance with the principles of this invention, the foregoing and additional objects are attained by providing in a sewing machine having memory means for storing selectively retrievable stitch pattern digital information to form a selected stitch pattern and at least one stitch forming instrumentality driven by the sewing machine main drive motor and variable in position over a predetermined range of positions between successive stitches to produce the selected stitch pattern, actuator means for imparting movement to the stitch forming instrumentality in accordance with the stitch pattern information, the actuator means comprising a control linkage coupled to the stitch forming instrumentality, a selectively movable position element, adder means responsive to the pattern information for moving the position element, means driven by the main drive motor for moving the control linkage in accordance with the position of the position element, and brake means alternately operative for preventing movement of the position element during operation of the moving means and for allowing movement of the position element during operation of the adder means.

BRIEF DESCRIPTION OF THE DRAWING

The foregoing will be more readily apparent upon reading the following description in conjunction with the drawing, in which.

DESCRIPTION OF THE PREFERRED EMBODIMENT

Figure 1:
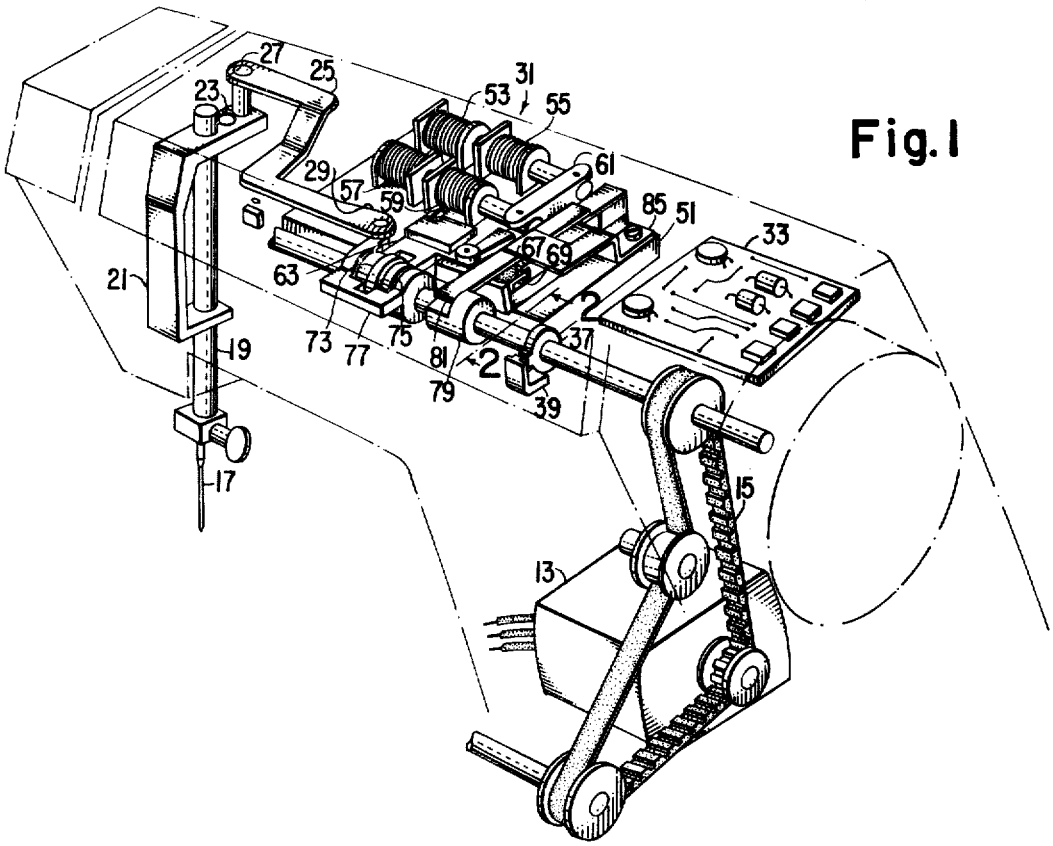
FIG. 1 is a perspective view of a portion of a sewing machine showing an electromechanical actuator mechanism constructed in accordance with the principles of this invention and arranged to influence the lateral position of the sewing machine needle.

Referring now to the drawing, wherein like reference numerals in different figures denote like parts, as shown in FIG. 1, the sewing machine includes an arm shaft 11 driven by the main sewing machine drive motor 13 through a timing belt 15. A needle 17 carried for endwise reciprocation by a needle bar 19 is mounted for lateral jogging movement in a gate 21 pivoted at 23. Any conventional connection (not shown) may be used between the arm shaft 11 and the needle bar 19 for imparting needle reciprocation. A drive link 25 pivoted at 27 to the gate 21 serves to impart lateral jogging movement to the needle 17. The drive link 25 is connected at its end 29 to an actuator mechanism, designated generally by the reference numeral 31, constructed in accordance with the principles of this invention. A printed circuit board 33 illustratively has mounted thereon memory units for storing stitch pattern information and control circuitry for operating the actuator mechanism 31 in accordance with the stored information. The circuitry on the board 33 will not be described in any greater detail than is necessary for an understanding of the principles of this invention and such explanation will be given in conjunction with a description of the block diagram of FIG. 5. Further shown in FIG. 1 is a position sensor assembly having a first portion 37 mounted for rotation with the arm shaft 11 and a second portion 39 fixed to the sewing machine frame, which position sensor is of conventional construction to provide a single pulse for each rotation of the arm shaft 11.

Although not shown in the drawing, the sewing machine includes a work feeding mechanism having a feed regulating guide block whose angular position determines the direction and magnitude of work feed between successive needle penetrations, the inclination of the guide block being controlled by an actuator mechanism which may be of the same type as the actuator mechanism 31 shown and described herein.

The actuator mechanism 31 includes a support plate 51 which is affixed to the sewing machine frame in a conventional manner. Mounted on the support plate 51 are four linear solenoids 53, 55, 57 and 59. The output of the actuator mechanism 31, as determined by the selective energization of the solenoids 53, 55, 57 and 59, controls the position of a drive lever 61 in a manner to be described hereinafter. The drive lever 61 is coupled to move a cam bar 63. To accomplish such movement, the cam bar 63 is provided with a slot (not shown) into which a pin 65 affixed to the drive lever 61 is inserted. The cam bar 63 is held for sliding movement along its longitudinal axis on the support plate 51 by a restraint block 67 and a restraint plate 69.

The cam bar 63 has a cutout opening 71 into which the periphery of a cam 73 extends. The cam 73 is a peripheral extension of a sleeve member 75 which is axially free on the arm shaft 11 but is keyed to rotate with the arm shaft 11. A yoke 77 spans the sleeve member 75. The yoke 77 encircles the arm shaft 11 and is free to move axially along the arm shaft 11 but does not rotate. The drive link 25 is coupled at its end 29 to the yoke 77.

Figure 2A:
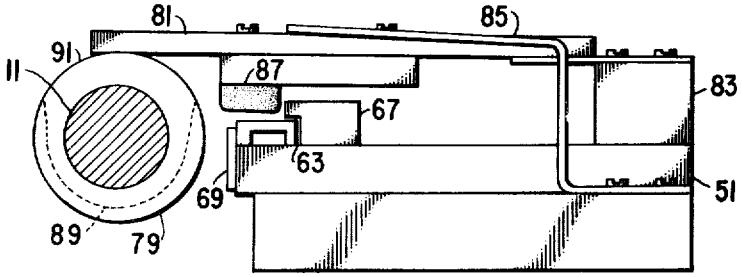
FIGS. 2A and 2B are side sectional views taken along the line 2—2 of FIG. 1 showing the brake means at two different times during an operating cycle of the sewing machine.
Figure 2B:
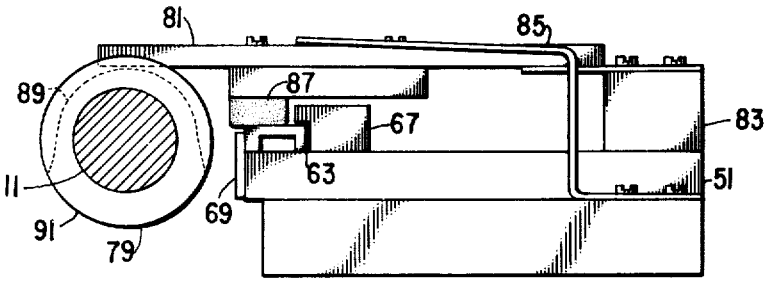

The actuator mechanism 31 according to this invention also includes a cam bar brake arrangement driven by a brake cam member 79 mounted for rotation on the arm shaft 11. The brake arrangement has a cam follower 81 mounted in cantilevered fashion from block 83 mounted on the support plate 51. A spring member 85 urges the cam follower 81 against the brake cam 79. Affixed to the underside of the cam follower 81 is a brake pad 87, constructed of a material having a high coefficient of friction. The brake cam 79 has an inner surface 89 closer to its center than its outer surface 91. As shown in FIG. 2A, when the brake cam 79 is in an angular orientation wherein the cam follower 81 is against the outer cam surface 91, the brake pad 87 is not in contact with the cam bar 63. As shown in FIG. 2B, when the brake cam 79 assumes the range of angular orientations wherein the cam follower 81 is not in contact with the outer cam surface 91, the brake pad 87 is forced against the cam bar 63 by the spring member 85, thereby preventing movement of the cam bar 63.

Referring to FIGS. 3A–C and 4A–D, the sequential operation of the actuator mechanism 31 constructed in accordance with the principles of this invention will now be explained. The cam 73 is a wedge-shaped cam having a maximum width region 73*a* and a minimum width region 73*b*. When the sewing machine needle moves from its upmost position towards its downmost position, the cam 73 within the opening 71 of the cam bar 63 goes to its maximum width region 73*a* and remains there for approximately one quarter of a full revolution of the arm shaft 11. At this time the brake is on, as indicated schematically by the representations 87′, 87″ of the brake pad 87 being in contact with the cam bar 63 in FIG. 3C. The solenoids 53, 55, 57 and 59 are not energized at this time so that the cam bar 63 is held by the brake mechanism to the position it assumed during the most recent prior solenoid energization. Thus, with the maximum width region 73*a* of the cam 73 within the opening 71 of the cam bar 63, the sleeve member 75 is caused to move longitudinally along the arm shaft 11 in accordance with the position of the cam bar 63. This causes the yoke 77 to move correspondingly and hence laterally position the needle bar 19.

As the arm shaft 11 continues to rotate, the brake mechanism eventually releases the cam bar 63 and the width of the cam 73 within the cam bar opening 71 decreases. Although the solenoids 53–59 are not energized and the brake mechanism is off, the friction forces and inertia of the yoke 77 and the drive link 25 maintain the position of the yoke 77 so that when the needle 17 reaches its downmost position, penetrating the work piece, it is in its desired lateral position. As the needle starts to move up, the solenoids 53–59 are selectively energized to set the next lateral position of the needle. After the surface of the cam 73 within the cam bar opening 71 passes its minimum width region 73*b*, FIG. 3B, the brake mechanism is again engaged to hold the cam bar 63. As the cam 73 moves within the cam bar opening 71 it causes the sleeve member 75 and hence the yoke 77 to move as hereinabove discussed.

Figure 3A:
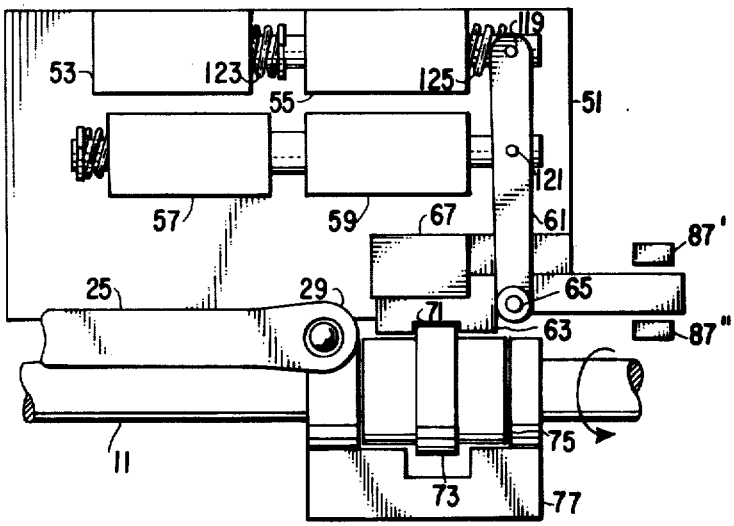
FIGS. 3A, 3B and 3C are top plan schematic views of the actuator mechanism constructed in accordance with the principles of this invention showing the relative positions of the elements of the actuator mechanism at different times during the sewing machine operating cycle.
Figure 3B:
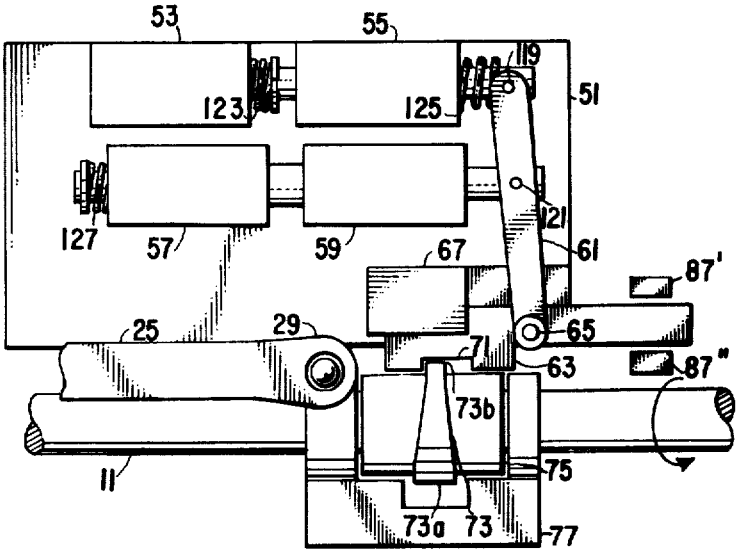
Figure 3C:
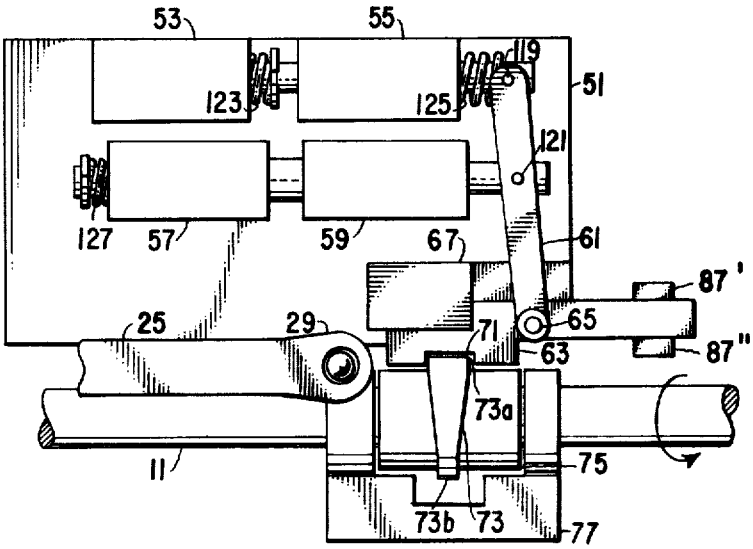
Figure 4A:
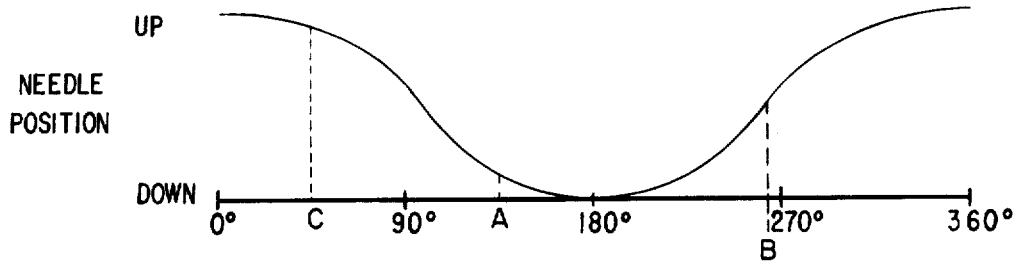
FIGS. 4A, 4B, 4C and 4D are time charts useful in explaining the operation of the illustrative arrangement constructed in accordance with the principles of this invention.
Figure 4B:
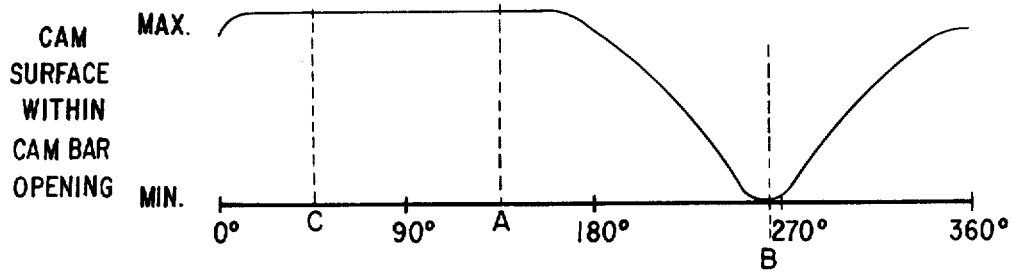
Figure 4C:
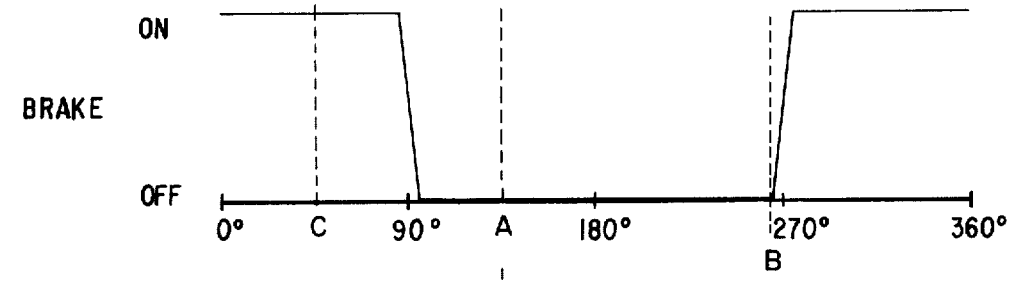
Figure 4D:
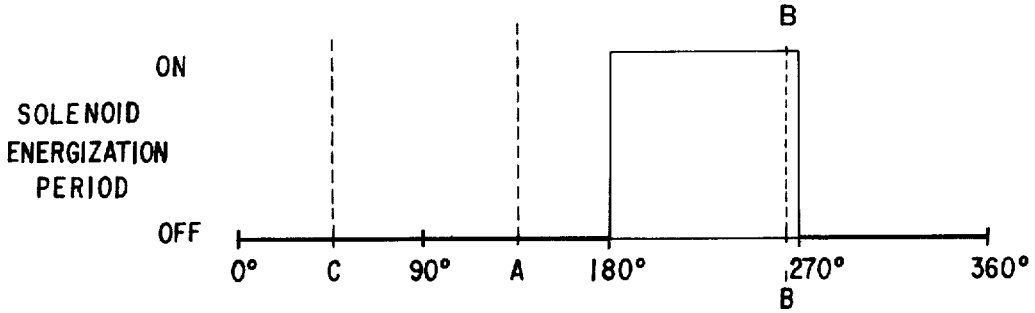

FIGS. 4A–D depict the relative movement of the pertinent elements of the sewing machine shown in FIG. 1 as a function of degrees of rotation of the arm shaft 11. In particular, FIG. 4A shows the relative vertical position of the needle 17, defined as being in its upmost position at 0 and 360 degrees of the arm shaft 11. FIG. 4B shows the width of the cam 73 within the cam bar opening 71. FIG. 4C shows the brake arrangement timing and FIG. 4D indicates the period when the solenoids 53–59 may be energized. The vertical line labeled "A" indicates the timing shown in FIG. 3A; the vertical line denoted "B" shows the same for FIG. 3B; and the vertical line denoted "C" shows the same for FIG. 3C.

Figure 5:
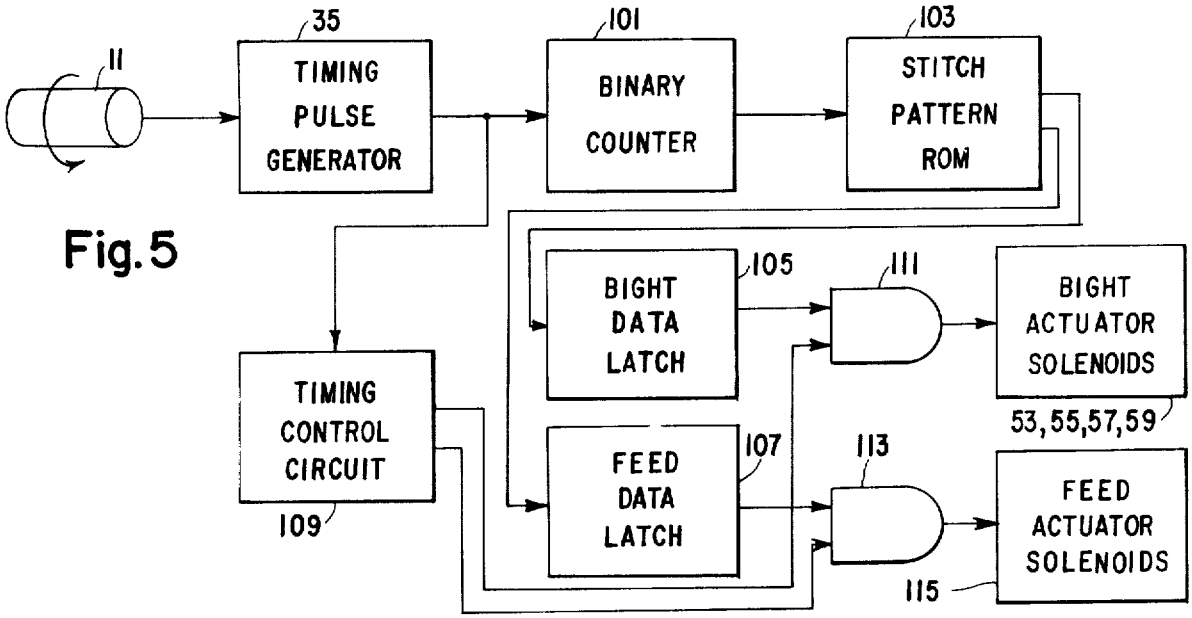
FIG. 5 is a block schematic diagram of an illustrative control system for the sewing machine shown in FIG. 1.

Referring now to FIG. 5 an illustrative control system will now be described. The sewing machine arm shaft 11 is connected to drive a timing pulse generator 35 which may preferably be of the type shown and described in U.S. Pat. No. 3,939,372. The pulse generator 35 provides a single timing pulse for each rotation of the arm shaft 11 and applies this pulse to a binary counter 101. Illustratively, the binary counter 101 is a five bit binary counter arranged to count to 31 and reset to zero on the following pulse. Thus, a pattern having 32 needle penetrations may be repeated indefinitely without special provision for setting the counter to zero. The output of the counter 101 is presented as the input address to a static read only memory 103 in which is stored the bight and feed information for the desired stitch pattern. The bight information output from the memory 103 is presented to a bight data latch 105 and the feed information from the memory 103 is presented to a feed data latch 107. A timing control circuit 109, responsive to the timing pulses from the pulse generator 35, applies gating signals at the appropriate times to AND gates 111 and 113 to control the selective energization of the bight actuator solenoids 53–59 and the feed actuator solenoids 115 in accordance with the stored information.

The adder portion of the actuator mechanism 31 comprises the four solenoids 53–59 and the drive lever 61 which is doubly pivoted at the points 119 and 121. The solenoids 53–59 are mounted in such a manner that only the solenoids 53 and 57 are secured to the support plate 51 and the solenoids 55 and 59 are individually attached to the rods of the solenoids 53 and 57, respectively. When mounted in this manner, the solenoids 53 and 57 drive the solenoids 55 and 59, respectively, and the solenoids 55 and 59 drive the lever 61. These latter solenoids, 55 and 59, are secured to the drive lever 61 and are spaced so that the lever 61 will pivot about either of the two pivot points 119 and 121. If the solenoids 53 and 55 move the lever 61, it will pivot about the point 121 whereas if the solenoids 57 and 59 move the lever 61, it will pivot about the point 119. If one or more of the solenoids 53 and 55 and one or more of the solenoids 57 and 59 drive the lever 61, its pivoting will be a compound pivoting about both the points 119 and 121.

Referring now to FIGS. 3A–3C, with the disclosed arrangement, the solenoids 53 and 55 have their rods biased toward the right by spring members 123 and 125, respectively. The solenoid 57 has its rod biased toward the left by the spring member 127 and the solenoid 59 has its rod biased toward the right by an internal spring member, not shown. The movements of the respective solenoids 53–59 when energized and the pivot lengths of the drive lever 61 are chosen to be so related that a direct binary input without any intermediate conversion can be utilized for positioning cam bar 63. Illustratively, the distance between the points 65 and 121 of the drive lever 61 is one and a half times as great as the distance between the points 121 and 119. Therefore, the actuation of the solenoids 53 and/or 55 will result in a lateral movement at the point 65 of one and a half times the lateral movement at the point 119. Similarly, the actuation of the solenoids 57 and/or 59 will cause lateral displacement at the point 65 of two and a half times the displacement at the point 121.

The relative displacements of the solenoids 53–59 are determined by the desired incremental movements of the drive link 25. Certain specifications may be established to provide an optimum system. For example, it would be advantageous to specify that with none of the solenoids 53–59 energized, the needle 17 would assume a center position. Also, it might be desirable to provide an equal number of equally spaced needle positions on either side of the center position. With these criteria established, and knowing the incremental distance between positions, and the relative pivot lengths of the drive lever 61, the relative "throws" of the solenoids 53–59 may be obtained by a simple mathematical computation. For example, choosing the solenoid 53 to have a throw of 1 unit and choosing the solenoid 55 to have a throw of 2 units (for binary purposes), and with the relative pivot lengths of the drive lever 61 as discussed above, and with seven equally spaced positions on either side of the central position so that with none of the solenoids 53–59 and all of the solenoids 53–59 energized at this central position, it may be determined that the solenoid 57 has a throw of 4.2 units and the solenoid 59 has a throw of 2.4 units. The magnitude of each of the units will depend upon the actual displacement desired.

Accordingly, there has been described an improved actuator for use in a sewing machine utilizing stitch pattern signal responsive actuators for positioning the needle and/or the work feeding mechanism between successive stitches of a predetermined pattern. The disclosed actuator possesses a number of distinct advantages. For example, the actual power for positioning the controlled mechanism is derived from the sewing machine main motor rather than from the actuator itself. Additionally, with no power to the actuator, the needle is in its central position, corresponding to straight stitching, which is performed most of the time, thereby providing an energy efficient arrangement. Further, the disclosed actuator responds directly to digital input signals without requiring any intermediate signal conversion. It is understood that the above-described arrangement is merely illustrative of the application of the principles of this invention. Numerous other arrangements may be devised by those skilled in the art without departing from the spirit and scope of this invention, as defined by the appended claims.

What is claimed is:

1. In a sewing machine having memory means for storing selectively retrievable stitch pattern digital information to form a selected stitch pattern and at least one stitch forming instrumentality driven by the sewing machine main drive motor and variable in position over a predetermined range of positions between successive stitches to produce said selected stitch pattern, actuator means for imparting movement to said stitch forming instrumentality in accordance with said stitch pattern information, said actuator means comprising:

a control linkage coupled to said stitch forming instrumentality;

a selectively movable position element;

adder means responsive to said pattern information for moving said position element, said adder means including a plurality of solenoids having respective movable output members and a drive lever coupled between said output members and said position element, said solenoids and said drive lever being so arranged that selective energization of said solenoids in accordance with said pattern information is translated into incremental movement of said position element;

moving means driven by the main drive motor for moving said control linkage in accordance with the position of said position element; and brake means alternately operative for preventing movement of said position element during operation of said moving means and for allowing movement of said position element during operation of said adder means.

2. The sewing machine according to claim 1 wherein said position element includes a bar having a cutout opening therein and said moving means includes a sleeve member rotatably driven by the main drive motor, a wedge shaped cam formed as a peripheral extension of said sleeve member and positioned within said cutout opening of said position element bar, and means coupling said control linkage to said sleeve member.

3. The sewing machine according to claim 2 wherein said coupling means includes a yoke spanning said sleeve member.

4. The sewing machine according to claim 1 wherein said brake means includes:

a cam rotatably driven by the main drive motor, said cam having an inner surface region and an outer surface region;

a cam follower biased to contact said cam; and a brake pad mounted on said cam follower and positioned to contact said position element when said cam follower is not in contact with said outer surface region so as to restrain said position element from moving.

* * * * *